US007472656B2

(12) United States Patent
Riach

(10) Patent No.: US 7,472,656 B2
(45) Date of Patent: Jan. 6, 2009

(54) TABLE CLOSURE MECHANISM

(75) Inventor: Jeffrey M. Riach, Cockeysville, MD (US)

(73) Assignee: Oakworks, Inc., Shrewsbury, PA (US)

( * ) Notice: Subject to any disclaimer, the term of this patent is extended or adjusted under 35 U.S.C. 154(b) by 1269 days.

(21) Appl. No.: 10/216,656

(22) Filed: Aug. 12, 2002

(65) Prior Publication Data

US 2003/0070596 A1 Apr. 17, 2003

Related U.S. Application Data

(60) Provisional application No. 60/311,122, filed on Aug. 10, 2001.

(51) Int. Cl.
*A47B 3/00* (2006.01)

(52) U.S. Cl. ..... 108/168; 108/172

(58) Field of Classification Search ..... 312/333; 108/93, 94, 59, 102, 103, 142, 143, 140, 108/139, 64, 65, 166–169, 171, 172, 174, 108/115; 292/102, 107, 108, 209, 210, 303, 292/304, DIG. 49, 63, 38
See application file for complete search history.

(56) References Cited

U.S. PATENT DOCUMENTS 1,133,254 A * 3/1915 Backus ..... 292/127
1,293,347 A * 2/1919 Corwin ..... 206/265
2,007,866 A * 7/1935 Lang ..... 160/95
2,203,202 A * 6/1940 Kun ..... 292/87
2,747,957 A * 5/1956 Lencioni ..... 108/36
2,903,313 A * 9/1959 Block ..... 108/35
3,313,564 A * 4/1967 Pultz ..... 292/87
3,397,001 A * 8/1968 Friedman ..... 292/87
3,980,326 A * 9/1976 Smith ..... 292/86
4,068,872 A * 1/1978 Smith ..... 292/87
4,112,859 A * 9/1978 Willenbacher ..... 112/217.1
4,363,403 A * 12/1982 Raucci et al. ..... 206/387.13
4,591,289 A * 5/1986 Vickers et al. ..... 403/322.4
4,915,034 A * 4/1990 Grabe et al. ..... 108/65
5,144,888 A * 9/1992 Heine et al. ..... 108/64
5,357,872 A * 10/1994 Wilmore ..... 108/35
5,438,937 A * 8/1995 Ball et al. ..... 108/64
5,943,965 A 8/1999 Riach et al.
5,975,593 A * 11/1999 Cress ..... 292/86
6,042,157 A * 3/2000 Shimotsu ..... 292/83
2005/0274302 A1 * 12/2005 Jin et al. ..... 108/126

* cited by examiner

*Primary Examiner*—Janet M Wilkens
(74) *Attorney, Agent, or Firm*—Studebaker & Brackett PC; Donald R. Studebaker

(57) ABSTRACT

A closure mechanism for maintaining a foldable table in a closed configuration and for allowing opening thereof. In one embodiment, the closure mechanism includes a keeper mounted to a first table section, a clasp mounted to a second table section that is adapted to engage the keeper to secure the first and second table sections together in the closed configuration, and a plunger adapted to deflect the clasp to thereby disengage the clasp from the keeper to allow opening of the foldable table. In one embodiment, the clasp includes a hook that engages the keeper, and a flexible central portion that allows deflection of the hook to disengage the hook from the keeper.

22 Claims, 3 Drawing Sheets

TABLE CLOSURE MECHANISM

CROSS REFERENCE TO RELATED APPLICATION

This application claims priority to U.S. Provisional Application No. 60/311,122 filed Aug. 10, 2001.

BACKGROUND OF THE INVENTION

1. Field of the Invention

The present invention is directed to closure mechanisms used to secure table sections of a foldable table.

2. Description of Related Art

Presently, there are several different closure mechanisms used for securing two table sections of foldable table together for transport. Such foldable tables include, but are not limited to, massage therapy tables. An example of such foldable massage therapy tables is disclosed in U.S. Pat. No. 5,943,965 to Riach et al. Most foldable tables are held closed with externally mounted steel or other metal hardware that is cumbersome to use, presses on individuals laying on top of the table, and is aesthetically unappealing.

A massage table manufacturer Astralight® uses a different type of system that relies upon the fact that there is not more than a moderate force working to open the two table sections. This system has no external release mechanism because it is located on the side of the table sections that are adjoined together by a hinge. Because of its positioning, this closure mechanism does not ensure that the table is held completely closed around the whole perimeter of the folded table.

Another massage table manufacturer Living Earth Crafts® uses a largely hidden closure mechanism which is located opposite the hinge end of the folded table. However, this design provides hardware on the outside of the table which can damage a floor when the unfolded table is laid flat on the floor without its legs extended. It also has a button that protrudes through the vinyl upholstery thus requiring holes in the upholstery which can eventually cause further tearing of the upholstery. Moreover, the cost to manufacture and install this closure mechanism is comparatively high.

Therefore, there exists an unfulfilled need for a closure mechanism for closing together two table sections of a foldable table that avoids the disadvantages of the known closure mechanisms. In particular, there is an unfulfilled need for a closure mechanism that is economical, easy to use, and is aesthetically appealing.

SUMMARY OF THE INVENTION

One advantage of the present invention is in providing a closure mechanism that is economical.

Another advantage of the present invention is in providing a closure mechanism that is easy to use.

Still another advantage of the present invention is in providing a closure mechanism that is aesthetically appealing.

Yet another advantage of the present invention is in providing a closure mechanism that minimizes number of components that are positioned outside of the table when the two table sections are closed together.

Still another advantage of one embodiment of the present invention is in providing a closure mechanism that may be folded out of the way when laying the unfolded table flat on the floor.

These and other advantages are attained by a closure mechanism of the present invention for maintaining a foldable table in a closed configuration and for allowing opening thereof. In accordance with one embodiment, the closure mechanism comprises a keeper mounted to a first table section of the foldable table, a clasp mounted to a second table section of the foldable table, the clasp being adapted to engage the keeper to secure the first and second table sections of the foldable table together in the closed configuration, and a plunger adapted to deflect the clasp to thereby disengage the clasp from the keeper to allow opening of the foldable table.

In accordance with one embodiment of the present invention, the clasp includes a hook that engages the keeper, and a flexible central portion that allows deflection of the hook to disengage the hook from the keeper. Correspondingly, the keeper includes a hook groove sized to receive the hook of the clasp, and an angled surface that facilitates engagement of the hook into the hook groove.

In one embodiment, the plunger is preferably mounted to the second table section together with the clasp. The plunger includes a flexible center portion that allows deflection of the plunger in a manner to deflect the clasp. In this regard, the plunger includes a handle that extends beyond the second table section. In one embodiment, the handle may be provided with an informational marking.

In accordance with another embodiment of the present invention, the plunger includes at least one flange that maintains positioning of the clasp relative to the plunger. The clasp is rotatable relative to the plunger so that the clasp may be positioned underneath the second table section by rotating the clasp relative to the plunger.

In accordance with another embodiment of the present invention, the plunger may be integral with the clasp. In such an embodiment, the plunger extends beyond the second table section. Whereas the closure mechanism may be made of any appropriate material, the closure mechanism may be economically made from metal, fiberglass, nylon, and/or plastic such as Delrin®.

In accordance with still another embodiment of the present invention, a closure mechanism is provided comprising a keeper mounted to a first table section, and a clasp mounted to a second table section of the foldable table, the clasp being adapted to engage the keeper to secure the first and second table sections of the foldable table together in the closed configuration. The clasp includes an integral plunger that extends beyond the second table section when the foldable table is in the closed configuration, the plunger being adapted to deflect the clasp to thereby disengage the clasp from the keeper to allow opening of the foldable table.

These and other advantages and features of the present invention will become more apparent from the following detailed description of the invention when viewed in conjunctions with the accompanying drawings.

DETAILED DESCRIPTION OF THE PREFERRED EMBODIMENT

Figure 1:
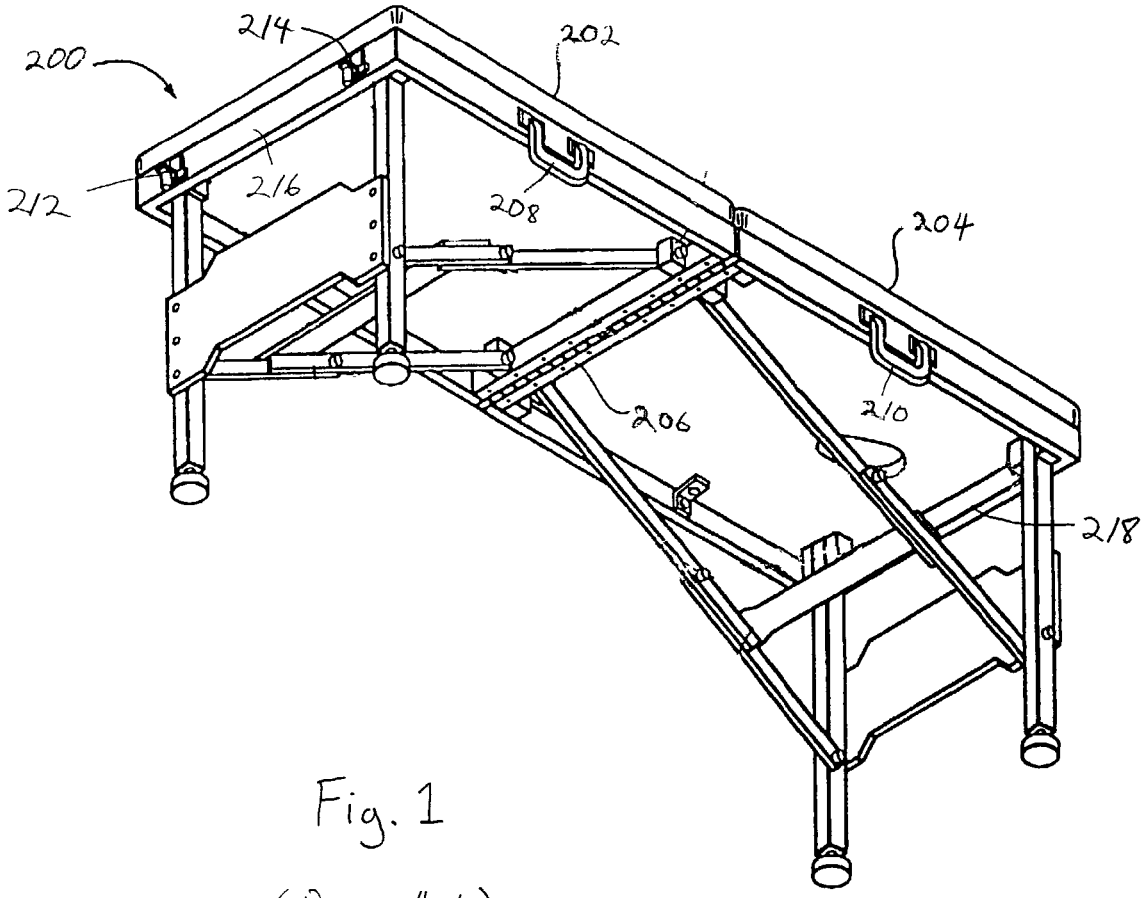
Fig. 1 (Prior Art)
FIG. 1 shows an underside perspective view of a foldable table for which the closure mechanism in accordance with the present invention may be used.

FIG. 1 shows an underside perspective view of a foldable table 200 for which a closure mechanism of the present invention may be used. As shown, the foldable table 200 includes a first table section 202 which is hingable attached to a second table section 204 via hinge 206 so that the foldable table 200 may be folded in a closed configuration, or unfolded in an open configuration shown. The foldable table 200 also includes various legs and support structure to allow elevation of the of the first table section 202 and second table section 204, such legs and support structures not forming part of the present invention and thus, the details and discussion of which are omitted.

When the foldable table 200 is in a closed configuration, it may be transported from one location to another by lifting the closed foldable table 200 by handles 208 and 210. In this regard, the foldable table 200 is also provided with a closure mechanism to secure the first table section 202 and second table section 204 together to maintain the closed configuration of the foldable table 200. In the illustrated example of FIG. 1, the closure mechanism of foldable table 200 includes buckles 212 and 214 which are secured to an outer surface of a first frame rail 216 of the first table section 202. The buckles 212 and 214 engage corresponding hooks (not shown) which are secured to an outer surface of a second frame rail 218 of the second table section 204. As previously described, because these components of the closure mechanism are positioned on the outer surface of the first and second frame rails 216 and 218, they are aesthetically unappealing, can contact a person lying on the table and can even damage the floor surface if the foldable table 200 is placed on the floor without the legs extended. These disadvantages of the prior art closure mechanism of foldable table 200 are minimized by a novel closure mechanism in accordance with the present invention, the details of which are described in further detail below.

Figure 2A:
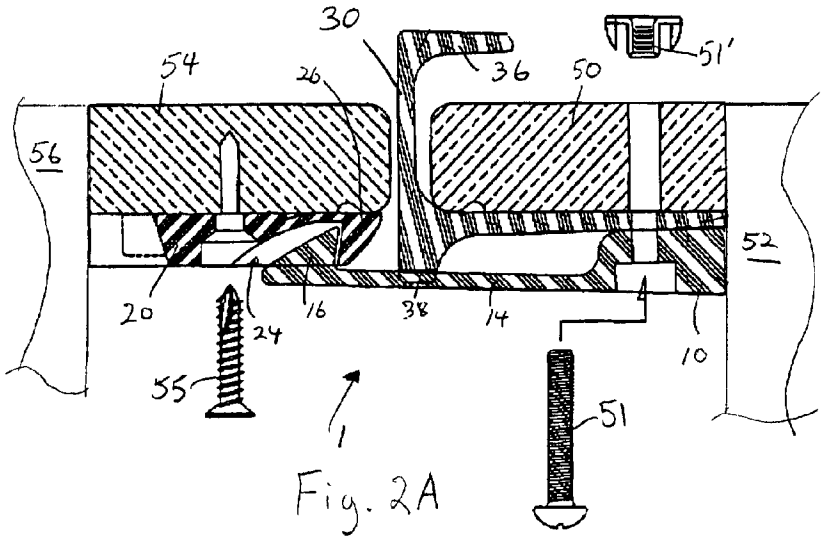
FIG. 2A shows a cross sectional view of the closure mechanism in accordance with one embodiment of the present invention which is installed on inside surfaces of frame rails of a foldable table.
Figure 2B:
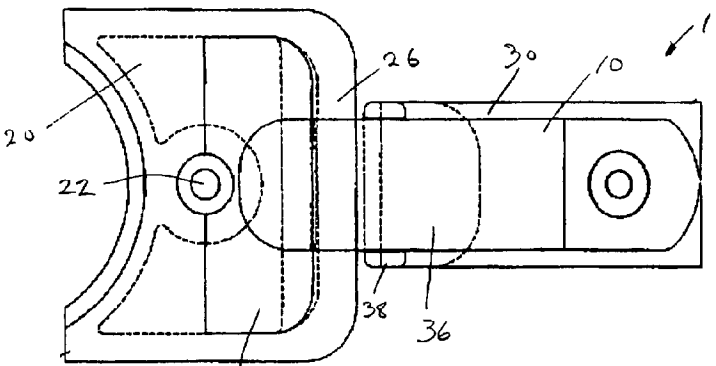
FIG. 2B shows a topographical view of the clasp, keeper and plunger of FIG. 2A, positioned for operation in accordance with one embodiment of the present invention.

FIGS. 2A and 2B illustrate closure mechanism 1 in accordance with one embodiment of the present invention that may be used as a closure mechanism for foldable tables such as the foldable massage table 200 discussed above relative to FIG. 1. FIG. 2A shows a cross-sectional view of the closure mechanism I which is installed on the inner surfaces of frame rail 50 of a first table section 52 and frame rail 54 of a second table section 56 of a foldable table. In the illustration of FIG. 2A, the first and second table sections 52 and 56 are in a closed configuration so that the frame rails 50 and 54 are in close proximity to one another and secured by the closure mechanism 1 of the present invention as shown. As can be appreciated, because the closure mechanism 1 is secured to the inner surfaces of frame rails 50 and 54, aesthetics is greatly improved since most of the closure mechanism 1 is hidden when the foldable table is in a closed configuration. As such, contact with the closure mechanism by a person laying on the table is minimized.

The closure mechanism 1 in the illustrated embodiment of FIG. 2A includes a clasp 10 which engages a keeper 20, and also includes a plunger 30 that is used to disengage the clasp 10 from the keeper 20, the details of these components being discussed in further detail below. As also shown, the clasp 10 and the plunger 30 are secured to the inner surface of frame rail 50 of the first table section 52 by fasteners 51 and 51' while the keeper 20 is secured to the inner surface of frame rail 54 of the second table section 56 by fastener 55.

Figure 3A:
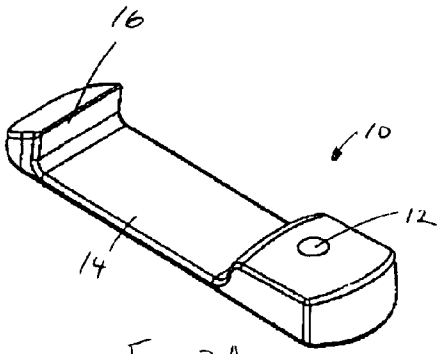
FIG. 3A shows a perspective view of the clasp in accordance with one embodiment of the present invention.
Figure 3B:
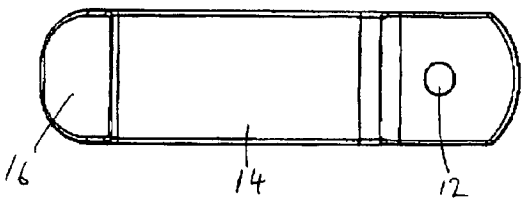
FIG. 3B shows a topographical view of the clasp of FIG. 3A.
Figure 3C:
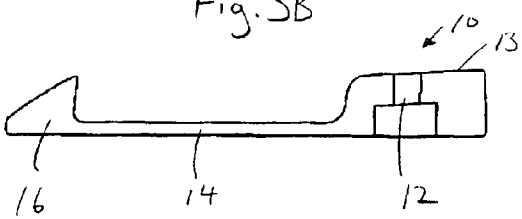
FIG. 3C shows a side view of the clasp of FIG. 3A.

FIGS. 3A to 3C show various views of the clasp 10 of the closure mechanism 1. As can be seen, the clasp 10 of the illustrated embodiment has a hook 16 which engages the keeper 20 at one end, and a pivot hole 12 at the other end to allow pivotable attachment to frame rail 50 of the first table section 52. FIG. 3C clearly shows that the central portion 14 of the clasp 10 has a thin cross-section to facilitate bending of the clasp 10 along the central portion 14. This flexibility is desirable to facilitate engagement and disengagement of the clasp 10 to the keeper 20, and to also allow the clasp 10 to be moved out of the way as discussed in further detail below. The area 13 near the pivot hole 12 is reinforced for strength and is inclined in the manner shown so that when the clasp 10 is secured to the frame rail 50, together with the plunger 30 in the manner shown in FIG. 2A, the hook 16 of the clasp 10 is pre-tensioned to engage the keeper 20. The hook 16 of the clasp 10 of the illustrated example is designed with an angled wedge shape which allows the hook 16 to easy move over the keeper 20 and to positively lock therewith as the two table sections are brought together into a closed position.

Figure 4A:
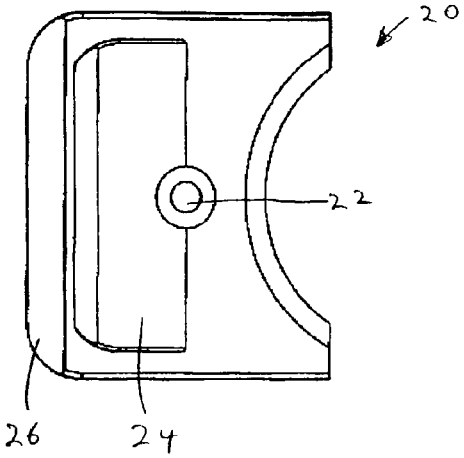
FIG. 4A shows a topographical view of the keeper in accordance with one embodiment of the present invention.
Figure 4B:
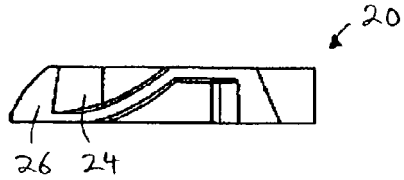
FIG. 4B shows a side view of the keeper of FIG. 4A.

FIGS. 4A and 4B more clearly show the keeper 20 that is engaged by the hook 16 of the clasp 10. FIG. 4A shows the attachment hole 22 for securing the keeper to the frame rail 54 of the second table section using the fastener 55 in the manner shown in FIG. 2A. As shown in FIG. 4B, the illustrated embodiment of the keeper 20 includes hook groove 24 for positively engaging the hook 16 of the clasp 10 when the closure mechanism 1 is in use. As can be seen, the keeper 20 of the illustrated embodiment is provided with an angled surface 26 that leads the hook groove 24 to thereby allow the hook 16 of the clasp 10 to be moved over into the hook groove 24 so as to be engaged therein.

Figure 5B:
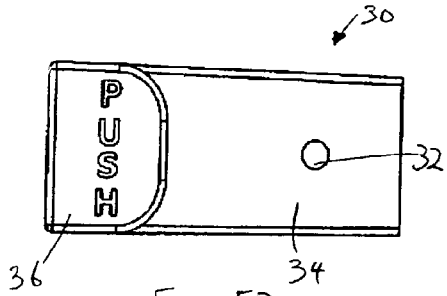
FIG. 5B shows a topographical view of the plunger of FIG. 5A.
Figure 5A:
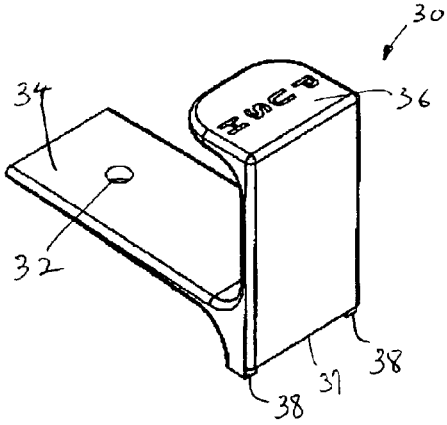
FIG. 5A shows a perspective view of the plunger in accordance with one embodiment of the present invention.
Figure 5C:
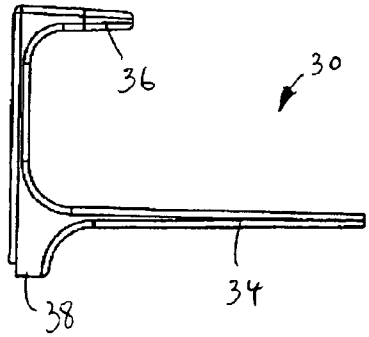
FIG. 5C shows a side view of the plunger of FIG. 5A.

FIGS. 5A to 5C show various views of the plunger 30 in accordance with one embodiment of the present invention which is used to disengage the hook 16 of the clasp 10 from the hook groove 24 of the keeper 20. The plunger 30 includes a hole 32 that aligns with the pivot hole 12 of the clasp 10 to allow securement to the frame rail 50 of the first table section 52 via fasteners 51 and 51' in the manner shown in FIG. 2A. The plunger 30 is designed to be flexible along the center portion 34 and extends beyond the frame rail 50 in the manner shown in FIG. 2A. A handle 36 is provided on the plunger 30 to allow disengaging of the closure mechanism as discussed below. Thus, in the illustrated embodiment, when the foldable table is in the closed configuration, only the handle 36 of the plunger 30 is visible thereby greatly enhancing the aesthetic appearance since buckles and hooks used in conventional closure mechanism are absent. In addition, in the present embodiment, the handle 36 is provided with informational marking "PUSH" which provides the user with indication of how to operate the closure mechanism 1. Of course, any type of marking such as a diagram or other text, for instance, "PRESS TO OPEN" may be provided instead.

The illustrated embodiment of plunger 30 also includes small flanges 38 that retain the central portion 14 of the clasp 10 in position between the flanges 38 so that the plunger 30 and the clasp 10 are substantially aligned relative to one another. This allows the plunger 30 to act upon the clasp 10 in the manner described further below. It should also be noted that whereas in the illustrated embodiment, two flanges 38 are provided which maintain the position of the central portion 14 of the clasp 10 therein between, other arrangements may be used in different embodiments to maintain the position of the clasp 10. For instance, in an alternative embodiment, a single flange may be provided centrally on the plunger which is received in a corresponding opening in the central portion of the clasp.

Referring again to FIG. 2A, the clasp 10 and the plunger 30 are mounted to frame rail 50 via pivot hole 12 and hole 32, respectively, using fasteners 51 and 51'. The handle 36 of the plunger 30 extends beyond the frame rail 50 and the first table section 52 when the two table sections are in their closed configuration. Again, the flanges 38 of the plunger 30 positions the central portion 1 of the clasp 10 therein between. The keeper 20 is mounted to the other frame rail 54 via the attachment hole 22 using fastener 55.

In operation, the closure mechanism 1 interlocks the two frame rails 50 and 54 together thereby closing the first table section 52 and second table section 56 together. In particular, as the first and second table sections 52 and 56 are brought together, the hook 16 of the clasp 10 rides up the angled surface 26 of the keeper 20, the central portion 14 of the clasp deflecting/flexing to create a spring action biasing the hook 16 in the direction of the keeper 20. Once the hook 16 of the clasp 10 reaches the hook groove 24 of the keeper 20, the spring action of the central portion 14 causes the hook 16 to engage the keeper 20 in the manner shown, thereby securing the frame rails 50 and 54 together so that the two table sections 52 and 56 are closed together in a closed configuration.

The handle 36 of the plunger 30 is pressed to release the frame rails 50 and 54 from one another and thereby allow the first and second table sections 52 and 56 to be separated into an open configuration. Pressing of the handle 36 causes the plunger 30 to flex along the center portion 34. The resulting deflection of the plunger 30 causes edge 37 of the plunger 30 to push against the clasp 10 which is positioned substantially aligned to the plunger 30 by the flanges 38. The clasp 10 correspondingly deflects along the central portion 14 and disengages the hook 16 of the clasp 10 from the hook groove 24 of the keeper 20. In this manner, the closure mechanism 1 of the illustrated embodiment may be operated to open the first and second table sections 52 and 56 so that the foldable table can be placed in an open configuration.

Thus, the closure mechanism 1 of the illustrated embodiment minimizes the number of hardware associated with a closure mechanism, that is located on the outside of the foldable table when the two table sections 52 and 56 are closed together since only the handle 36 of the plunger 30 extends outside of the frame rails 50 and 54. Thus, comfort of the client utilizing the table is increased while the aesthetics is also improved.

In addition, the illustrated embodiment of the closure mechanism 1 is also especially advantageous in that the clasp 10 may be rotated out of the way once the frame rails 50 and 54 are released from one another in the manner described above. In particular, as previously noted, the flanges 38 of the plunger 30 positions the central portion 14 of the clasp 10 so that upon pressing handle 36 of the plunger 30, the clasp 10 is deflected to disengage the hook 16 from the keeper 20. Once the two table sections 50 and 54 are separated from one another, the clasp 10 may be manually deflected further away from the plunger 30 to clear the flanges 38 of the plunger 30. This allows the clasp 10 to be rotated out of the way underneath the frame rail 50 if so desired, for instance, rotated into or out of the page in FIG. 2A. This rotation of the clasp 10, of course, is made possible by the fact that the plunger 30 is a separate component from the clasp 10 in the present embodiment.

In addition, it should also be noted that the illustrated preferred embodiment of the present invention reduces attachment of fasteners or parts on the outside of the upholstery of the first table section 52 and second table section 56, thus minimizing risk of damage to the upholstery when assembling and using the foldable table. In addition, the illustrated embodiment of the present invention also allows easy replacement of various parts of the closure mechanism 1 in the field by the user of the foldable table. Whereas the closure mechanism 1 in accordance with the illustrated embodiment of the present invention is especially advantageously applicable to portable massage tables which are folded to be carried into the facilities of clients, it may also be used for any type of folding tables.

Figure 6:
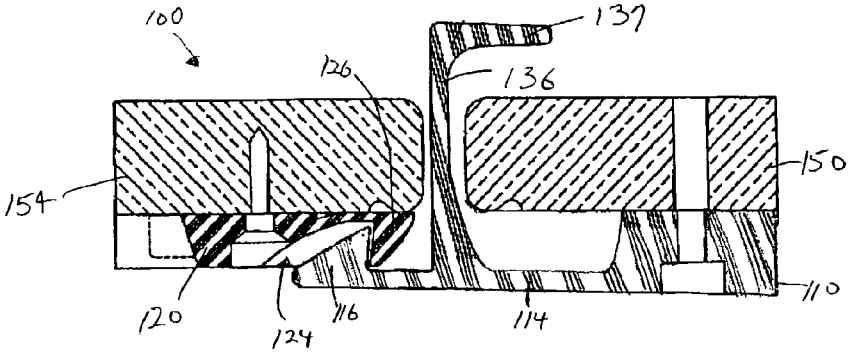
FIG. 6 shows a cross sectional view of the closure mechanism in accordance with another embodiment of the present invention in which the plunger is integral with the clasp.

FIG. 6 shows a cross sectional view of a closure mechanism 100 in accordance with another embodiment of the present invention in which the plunger is integral with the clasp. As illustrated, clasp 110 is adapted to be secured to frame rail 150 of one table section (not shown), and keeper 120 is adapted to be secured to frame rail 154 of the other table section (not shown). The clasp 110 is provided with a central portion 114 that has a thin cross-section to allow deflection thereof. In addition, the clasp 110 is also provided with a hook 116 like the embodiment of FIG. 2A which rides up the angled surface 126 of the keeper 120 and engages the hook groove 124 of the keeper 120 to secure the frame rails 150 and 154 together to maintain the foldable table in a closed configuration.

In contrast with the embodiment of FIG. 2A, the clasp 110 of FIG. 6 is also provided with a plunger 136 that is integrated with the clasp 110. As shown, the plunger 136 extends beyond the frame rail to allow actuation thereof and includes a handle 137. By pressing on the handle 137 of the clasp 110, the hook 116 provided at the tip of the clasp 110 is displaced so that it disengages the hook groove 124 of the keeper 120 thereby allowing the frame rails 150 and 154 of the foldable table to be separated.

The illustrated embodiment of FIG. 6 is advantageous in that it further reduces manufacturing and product costs as compared to the previously described embodiment of FIG. 2A. However, the hook end 116 that engages the keeper 120 may not be readily moved under the frame rail 150 as described above relative to the previously described embodiment of FIG. 2A. This is because the plunger 136 which extends beyond the frame rail 150 is integral with the clasp 110 thereby limiting rotation thereof. Therefore, whereas the closure mechanism 100 of FIG. 6 provides some of the advantages noted above, closure mechanism 1 of FIG. 2A provides further advantages as can now be more fully appreciated.

The various components of the closure mechanisms 1 and 100 described above may be made from a plastic such as Delrin® in accordance with one embodiment. However, in other embodiments, these can alternatively be made of a different materials such as other types of plastics, fiberglass, nylon, etc. or even machined from various metals. In this regard, any appropriate materials may be used in manufacture of these components.

As can now be appreciated from the discussion above, the closure mechanisms in accordance with the present invention as shown in FIGS. 2A and 6 are easier to use, inexpensive to manufacture and install, and is aesthetically more appealing than conventional closure mechanisms. In addition, in the embodiment of FIG. 6, the closure mechanism also allows the hook to be folded out of the way when laying the table flat on the floor, thereby eliminating the possibility of damage to the floor caused by other closure mechanisms.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

I claim:

1. A foldable table, comprising:

a closure mechanism for maintaining the foldable table in a closed configuration and for allowing opening thereof, said closure mechanism including, a keeper mounted to a first table section of said foldable table;

a clasp mounted to a second table section of said foldable table, said clasp being adapted to engage said keeper to secure said first and second table sections of said foldable table together in said closed configuration; and a plunger adapted to deflect said clasp to thereby disengage said clasp from said keeper to allow opening of said foldable table, wherein said clasp is rotatable relative to said plunger.

2. The closure mechanism of claim 1, wherein said clasp includes a hook that engages said keeper.

3. The closure mechanism of claim 2, wherein said clasp includes a flexible central portion that allows deflection of said hook to disengage said hook from said keeper.

4. The closure mechanism of claim 1, wherein said keeper includes a hook groove.

5. The closure mechanism of claim 2, wherein said keeper includes an angled surface that facilitates engagement of said hook into said hook groove.

6. The closure mechanism of claim 1, wherein said plunger is mounted to said second table section together with said clasp and extends beyond said second table section.

7. The closure mechanism of claim 6, wherein said plunger includes a flexible center portion that allows deflection of said plunger in a manner to deflect said clasp.

8. The closure mechanism of claim 6, wherein said plunger includes a handle.

9. The closure mechanism of claim 8, wherein said handle includes informational marking.

10. The closure mechanism of claim 6, wherein said plunger includes at least one flange that maintains positioning of said clasp relative to said plunger.

11. The closure mechanism of claim 1, wherein said clasp is positionable underneath said second table section by rotating said clasp relative to said plunger.

12. The closure mechanism of claim 1, wherein said plunger is integral with said clasp, and extends beyond said second table section.

13. The closure mechanism of claim 12, wherein said plunger includes a handle.

14. The closure mechanism of claim 13, wherein said handle includes informational marking.

15. The closure mechanism of claim 1, wherein said closure mechanism is made of at least one of metal, fiberglass, nylon, and plastic.

16. A foldable table, comprising:

a closure mechanism for maintaining the foldable table in a closed configuration and for allowing opening thereof, said closure mechanism including, a keeper mounted to a first table section;

a clasp mounted to a second table section of said foldable table, said clasp being adapted to engage said keeper to secure said first and second table sections of said foldable table together in said closed configuration, said clasp including a reinforced area and a central portion, said central portion having a thin cross-section smaller than a cross-section of said reinforced area; and a plunger that extends beyond said second table when said foldable table is in said closed configuration, said plunger being adapted to deflect said clasp to thereby disengage said clasp from said keeper to allow opening of said foldable table.

17. The closure mechanism of claim 16, wherein said clasp includes a hook that engages said keeper.

18. The closure mechanism of claim 17, wherein said clasp includes a flexible central portion that allows deflection of said hook to disengage said hook from said keeper.

19. The closure mechanism of claim 18, wherein said keeper includes a hook groove sized to receive said hook.

20. The closure mechanism of claim 19, wherein said keeper includes an angled surface for facilitating engagement of said hook into said hook groove.

21. The closure mechanism of claim 16, wherein said plunger includes a handle with an informational marking.

22. The closure mechanism of claim 16, wherein said closure mechanism is made of at least one of metal, fiberglass, nylon, and plastic.

* * * * *